United States Patent [19]

Wright

[11] 3,971,279

[45] July 27, 1976

[54] COPY TRIMMER MACHINE

[76] Inventor: William T. Wright, 1800 Stokes St., San Jose, Calif. 95126

[22] Filed: Sept. 22, 1975

[21] Appl. No.: 615,477

[52] U.S. Cl. ..... 83/425.4; 83/649

[51] Int. Cl.[2] ..... B26D 7/00; B26D 1/02

[58] Field of Search ..... 83/425.4, 425.3, 425.2, 83/425.1, 425, 649, 407

[56] References Cited

UNITED STATES PATENTS

| | | | |
|---|---|---|---|
| 904,247 | 11/1908 | Cameron | 83/425 |
| 1,998,357 | 4/1935 | Carlson | 83/425 X |
| 2,822,046 | 2/1958 | Krueger | 83/425 |
| 3,176,555 | 4/1965 | Bowker et al. | 83/425 X |
| 3,795,164 | 3/1974 | Schneider | 83/425.4 X |

*Primary Examiner*—Willie G. Abercrombie

[57] ABSTRACT

Paper on which a column of material, printed by a phototype setting process, is guided from a roll by a pair of accurately adjustable guides past a pair of mounted conventional type razor blades which have been accurately adjusted to slit the paper very close to the columnar material, as the paper is pulled from the roll by means of a pair of positive driven rollers. Tension is maintained on the paper as it moves past the cutting blades and following the slitting of the paper, the printed material is withdrawn while the waste automatically separates and drops into a waste receptacle.

8 Claims, 5 Drawing Figures

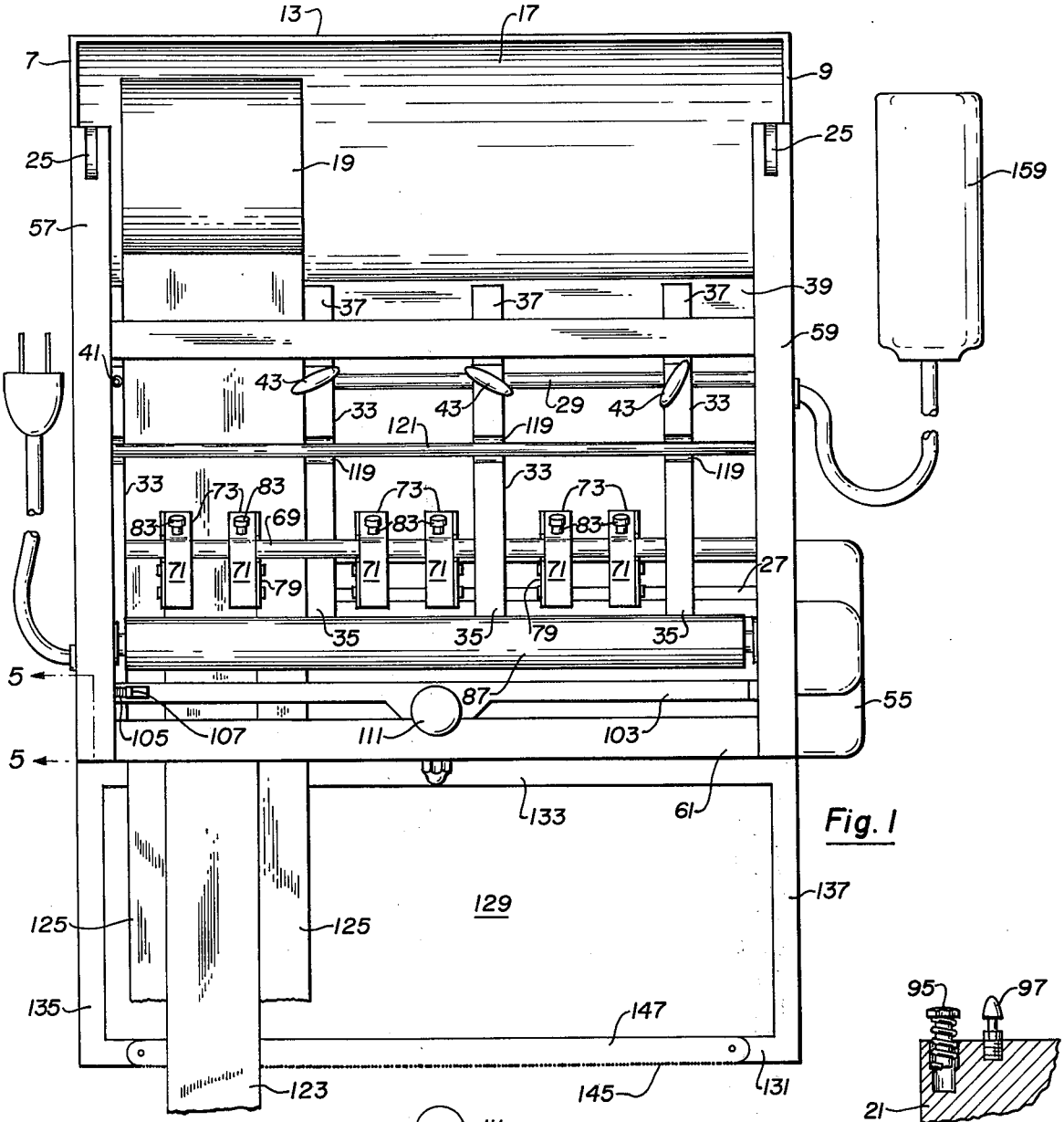
Fig. 1
Fig. 5
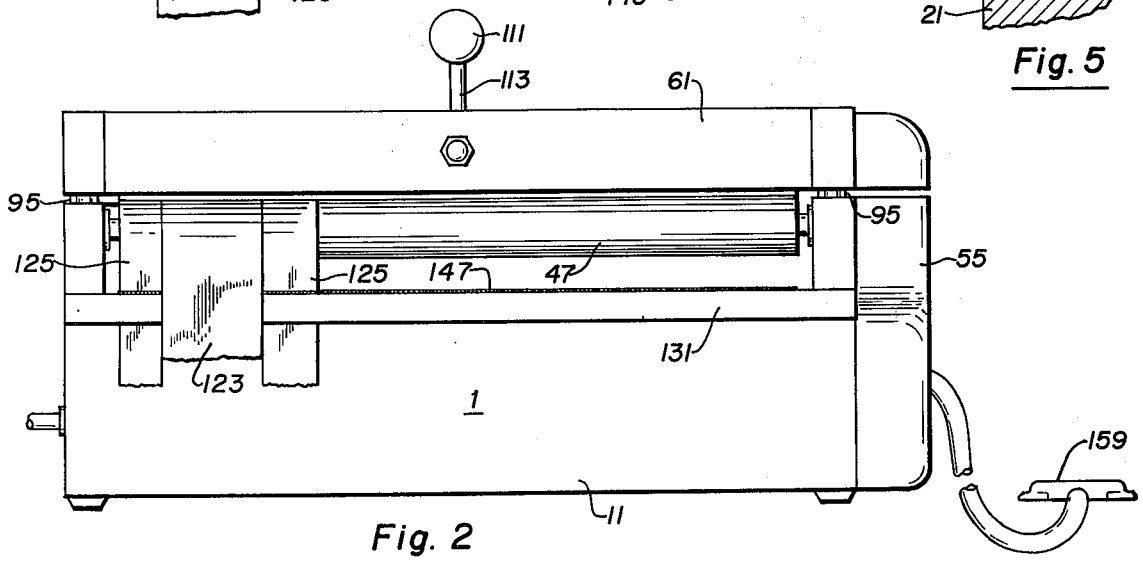
Fig. 2

COPY TRIMMER MACHINE

My invention relates to paper trimmers and more particularly to the one for trimming photocopy paper on which a printout or column of type has been produced by phototypesetting equipment on long rolls of photo paper which comes in standard widths, such as 2 inches, 4 inches, 8 inches, and 11½ inches.

One of the most time consuming operations of the phototypesetting process is the accurate trimming of the left and right margins of such paper to, as close as possible, the printed column, in preparing the material for the waxing of the backside for application to a backing or grid sheet. When the trimming operation is performed manually, as with the aid of a knife and straight edge, or with the aid of a conventional office type paper cutter, the operation is not only time consuming but tedious and not too exacting.

Efforts to automate or semi-automate this stage of the phototypesetting process, has produced a machine in which a pair of adjustably spaced circular cutting knives rotating against a steel drum, slice the paper as the paper is fed between the two rotating cutters and the steel drum, by driving one or the other.

Such machine receives and trims but one column at a time, and if the feeding of the paper becomes erratic, a close accurate trim is very difficult if not impossible to realize. Also, when the cutter blades become dull, due to the pressure and drive action between them and the steel drum, they must be removed and sharpened, all of which is time consuming and costly.

Among the objects of my invention are:

1. To provide a novel and improved trimming machine, primarily adapted for the trimming of printed columnar material as produced in the phototypesetting process;

2. To provide a novel and improved trimming machine, which is extremely accurate in the trimming of columnar material encountered in the process of phototypesetting;

3. To provide a novel and improved trimming machine, which trims both sides of a column simultaneously and accurately;

4. To provide a novel and improved trimming machine, of the above character which can trim a plurality of columns at the same time.

5. To provide a novel and improved trimming machine which uses conventional type safety razor blades as cutting elements;

6. To provide a novel and improved trimming machine capable of adjustment to trim a plurality of columns of different widths;

7. To provide a novel and improved trimming machine which maintains adequate tension on the paper as the paper is being sliced;

8. To provide a novel and improved trimming machine which automatically separates the waste from the desired printed material and drops it into a suitable waste receptacle.

Additional objects of my invention will be brought out in the following description of a preferred embodiment of the same, taken in conjunction with the accompanying drawings where;

FIG. 1 is a plan view of the trimming machine of the present invention, depicted in its functioning condition;

FIG. 2 is a front view in elevation of the machine as illustrated in FIG. 1;

FIG. 5 is a view in section through the side member 21, taken in the plane 5—5 of FIG. 1.

Figure 3:
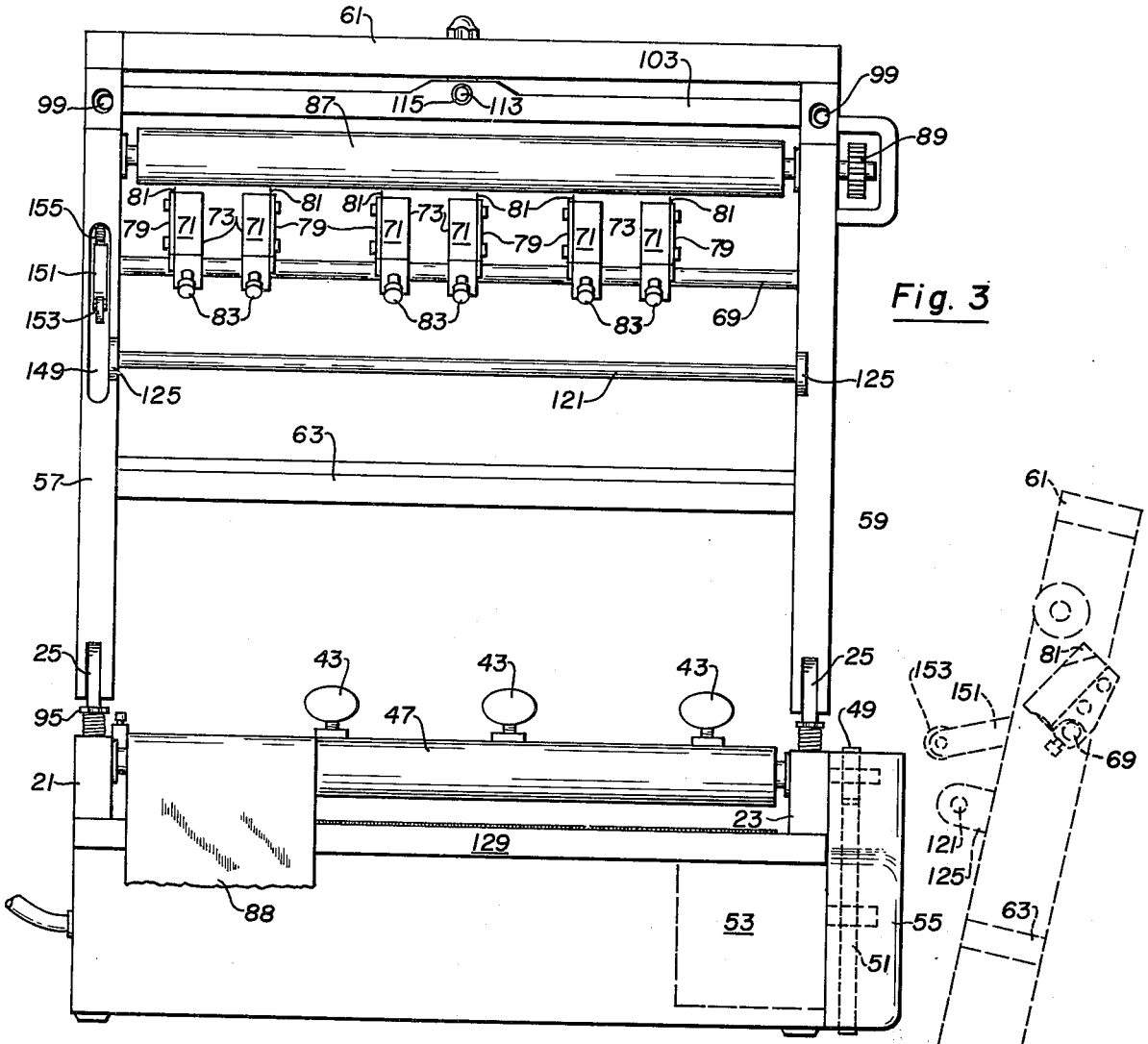
FIG. 3 is a front view in elevation of the machine of FIG. 1, in a non-functioning or loading condition, with a hinged cutter assembly in raised position.
Figure 4:
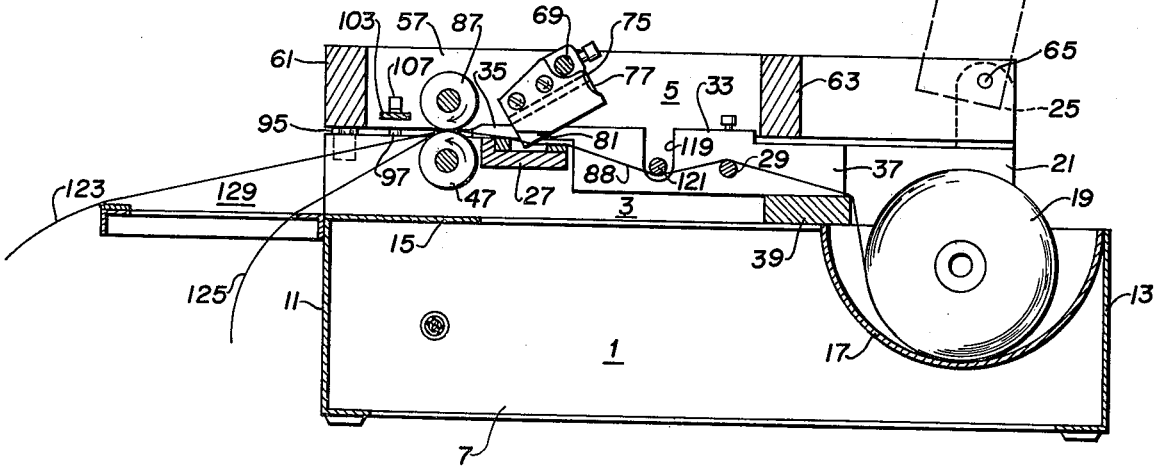
FIG. 4 is a side view in elevation of the machine of FIG. 1 in its functioning condition, and depicting, in phantom, the hinged cutter assembly in raised position as illustrated in FIG. 3.

Referring to the drawings for details of my invention in its preferred form, the machine, in general, involves a base frame 1 on which is mounted an adjustable paper guide assembly 3 with a cutter assembly 5 hingedly secured adjacent the rear end of the guide assembly.

The base frame comprises parallel inwardly flanged side walls 7 and 9 connected by a front wall 11 and a rear wall 13. Along the upper edge of the front wall, is a platform 15, while adjacent the upper edge of the rear wall, is a trough 17 of sufficient radius to receive a roll 19 of paper such as conventionally used in the phototypesetting process.

The adjustable paper guide assembly 3 is of the same overall general size and shape as the base frame 1 on which it is mounted, and involves parallel side members 21 and 23 affixed to the base frame, each along the inwardly flanged upper edge of one of the side walls thereof, from the front end of the base frame to a point approaching the rear end, where it terminates in a hinge pin support 25.

Extending between these side members 21, 23 and supported thereby, are a shallow channel 27 located in spaced relationship to the front end of the base frame, and to the rear of this shallow channel is a transverse rod 29.

This transverse rod slidably supports a plurality of paper guides 33, each including a front lip 35 adapted to span and rest on the front rim of the shallow channel for sliding support, and a tail section 37. A flat bar 39 supported by and between the side members 21, 23 just beneath the tail sections of the guides, will preclude clockwise rotation of the guides on the rod 29 at any time. One end guide 33′ which can be somewhat thinner than the others, may be permanently fixed against one of the side members by a set screw 41 against the rod 29.

To securely maintain an adjusted position of each of the other guides, a thumb screw 43 passing down into the upper edge of the guide in line with the shaft 29, is adapted to engage the shaft and clamp the guide thereto and retain it in any desired position.

A feed roller 47 constituting one of a pair of rollers, is rotatably supported between the side members 21, 23 just to the front of the shallow channel 27, with its shaft extending through one of the side members for mounting of a pinion or gear 49 for drive purposes, such pinion or gear meshing with a larger gear 51 mounted on the shaft of a drive motor 53 which is appropriately mounted within the base frame, on the proximate side wall thereof. The gear train thus formed is enclosed by a gear casing 55 for safety.

Hingedly secured to the side members of the guide assembly adjacent the rear ends thereof is the cutter assembly 5.

This cutter assembly involves a frame including two side members 57 and 59 connected by a front crossmember 61 and an intermediate crossbar 63, the rear end of each side member being notched to permit straddling of one of the hinge pin supports on the guide frame, for hinge connection thereto by a hinge pin 65.

Supported by and between the two side members of the cutter assembly is a rod 69 on which are slidably mounted, a plurality of cutters 71.

Each cutter involves a block 73 through one corner of which the rod 69 passes, the block having a shallow groove in one side to receive one side of the backbone or reinforcement 75 across the top edge of a single edge type safety razor blade 77, to permit the blade proper to rest flush against the grooved side of the block, to which it is clamped by a screw attached clamping plate 79 having a corresponding groove to receive the opposite side of the backbone.

The forward corner of both the block and clamping plate are removed to expose a cutting corner 81 of the blade, leaving the rest of the blade covered by the block and plate for safety.

A set screw 83 into an edge of the block is adapted to engage the shaft 69 and lock the block and included blade at any desired position along the shaft.

The location of the rod is such as to position the cutting point 81 of each blade above the shallow channel of the guide assembly below.

Aside from being slidably adjustable along the rod 69, each cutter is also angularly adjustable to the extent of bringing the exposed cutting corner of the blade into the channel to enable it to slit paper being pulled across the channel.

Also supported by and between the side members of the cutter assembly in position to functionally cooperate with the drive roller 47 of the guide assembly, is the second roller 87 of the pair, for driving paper 88 between them from the roll 19, this second roller having a shaft passing through the appropriate side member 59 to carry a pinion or gear 89 of the same size as that of the first roller and in mesh therewith, whereby both rollers will rotate at the same speed but in opposite directions when driven by the motor below.

As previously indicated, a column of printed material in the phototypesetting process is printed on rolls of paper which is then trimmed on each side of the printed column as closely as practical.

In employing the machine of the present invention, the printed roll 19 is placed in the trough 17, and after adjusting the spacing between a pair of guides 33 to the exact width of the paper, the paper is withdrawn from the roll and threaded over the crossbar 39 and between the guides by way of the upper surface of the shaft 29 on which the guides are installed, then across the channel 27 and over the lower feed roller 47.

The cutter assembly, which, until now, would be in its upper, lifted position, is lowered, but prior to engagement of the cutting blades with the paper, the cutters must be adjusted to their respected cutting positions with respect to the column of printed material.

To facilitate the making of this adjustment of the cutters, provision is made for supporting the cutter assembly in an intermediate position, sufficiently close to the paper to permit rotational adjustment of the pertinent cutters to positions just short of contact with the paper, leaving the cutters free for sliding adjustment, yet sufficiently close to the paper to enable accurate positioning with respect to the column of printed material, along the edges of which the cutters are to trim. When properly adjusted, the cutter assembly may then be urged to its final cutting or trimming position, causing the cutting blades to puncture the paper and ready themselves for trimming as the paper is then moved forward and withdrawn from the roll.

To automatically support the cutter assembly at such intermediate position for adjustment of the cutters, a compression spring supported stop 95 is installed in each front end of the side members of the guide assembly, such spring supported stops being capable of supporting the front end of the cutter assembly at a sufficient height above the guide assembly to hold the cutters in proper position just above the paper and with the upper roll pinion or gear 89 preferably just out of engagement with the lower roller pinion or gear 49.

Following adjustment of the cutters manual pressure applied downwardly against the cutter assembly, can force it to its functioning position against the resistance of the spring supported stops, with the cutter blades puncturing the paper and the upper roller pinion or gear in mesh with the one associated with the lower roller.

In such functioning position, the cutter assembly may be removably latched, and this, in the preferred embodiment of the invention under consideration, is accomplished automatically.

The latch mechanism for accomplishing this may involve a latch pin 97 on each side member of the guide assembly, just behind the proximate spring supported stop, such pin being adapted to pass through an opening 99 in the corresponding side member of the cutter assembly, where it can enter and be latched onto by one end of a transverse latch bar 103 which is biased to latching position by a small spring 105 interposed between one side member of the cutter assembly and an abutment 107 close by on the latch bar.

A latch handle involving a ball 111 and stem 113, is affixed to the innerside of the front member 61 of the cutter assembly, with the lower end of the stem entering an opening 115 in the latch bar. It can, by swinging it slightly in one direction, shift the latch bar from its latching engagement with the latch pins, to a position out of latching engagement, whereby the cutter assembly may be elevated to make accessible, the guide assembly, for whatever steps have to be performed in connection therewith.

With the cutter assembly latched in its functioning position, energizing of the motor will then drive the rollers, which in turn will withdraw the paper from the roll at a constant speed, causing the paper to pass the cutting blades to enable them to trim the waste material from the paper.

Effective trimming of the paper under the circumstances, calls for maintaining the paper under constant tension, particularly as it passes under the cutting blades.

With this in mind, each of the paper guides 33 is provided with a notch 119 in its upper edge at a location between the guide shaft 29 and the shallow channel 27, and of sufficient depth to extend below both the shaft and the channel. The notches are in alignment to receive a transverse shaft 121 supported in depending ears 125 from the side members of the cutter assembly, the rod being suspended from the cutter assembly, sufficient to engage and depress the paper into the notches upon lowering of the cutter assembly to its functioning position, whereby to tension the paper, particularly that portion between the tensioning rod 121 and the drive rollers, where the actually trimming occurs.

The slitted paper emerges from the machine as the printed column portion 123 and waste portions 125.

To separate the trimmed or waste material 125 from the desired printed column 123, a separating frame 129 may be added to the front wall of the base frame. This is a relatively narrow rectangular frame running the full length of the front wall and comprising front and rear members 131, 133 respectively, and end members 135, 137.

Upon starting a trimming operation, if the columnar material is guided across the frame and the waste material guided through the frame, a waste paper basket or receptacle positioned beneath the frame, will collect the waste material while the columnar material can be collected to the length desired and then cut off.

A serrated edge 145 along the front member of the separating frame, will facilitate cutting. Such a serrated edge may conveniently be realized by application of a hacksaw blade 147 to the upper side of the front member of this frame.

As a safety factor in preventing exposure of an operator to the exposed cutting edges of the various cutters, provision is made for moving the cutters to a guarded position as the cutter assembly is raised from its functioning position.

To accomplish this, the shaft 69 on which the cutters are mounted, is rotatably installed at its ends in the side members of the cutter assembly. One of these side members, at the location of support of this shaft, is provided on its underside, with a relatively long narrow slot 149 sufficiently deep to expose the proximate end of the shaft and permit affixing to such exposed end, a cutter position control arm 151 extending at an angle out of the slot and terminating in a roller 153. With the shaft 69 rotated to bring the exposed cutting corners of the blades pointing toward the proximate roller 87 which now takes on the added function of a protective guard, the position control arm is fixed to the shaft with control arm extending angularly from the slot, and is retained in its angular position by a spring 155 anchored at one end to the side member 57 at the proximate end of the slot, and at its other end to a point on the control arm within the slot.

As the cutter assembly is lowered, the control arm is designed to engage the proximate side member of the guide assembly in time to effect rotation of the cutters to their functioning position by the time latching occurs.

Contact of the control arm with the side member of the guide assembly is furthermore timed to occur sufficiently in advance of engagement of the cutter assembly with the spring supported stops to effect sufficient rotation of the cutters to bring the cutting edges close to the paper without actual contact therewith, in order to enable adjustment of the cutters to their trimming positions.

With the foregoing arrangement, upon lifting of the cutter assembly on its hinges, the control arm spring will retract the control arm to cause the cutters to rotate to their safety positions, where the proximate rollers will protect an operator from accidental contact with the cutting edges.

By connecting a foot actuable switch 159 in circuit with the motor 53, an operator may turn the machine on and off at will, while leaving his hands free to perform whatever chores may be called for while operating such machine.

It will be apparent from the foregoing that the invention as illustrated and described, will fulfill all the objects attributable thereto, and while I have illustrated and described the same in its preferred form, it will be apparent that the invention as illustrated and described, is subject to alteration and modification without departing from the underlying principles involved, and I, accordingly, do not desire to be limited in my protection to the specific details so illustrated and described, except as may be necessitated by the appended claims.

I claim:

1. A copy trimmer machine comprising a base frame having means for supporting a roll of paper to be trimmed, a guide assembly supported on said base frame and including means for guiding paper from such roll past a trimming location, a cutter assembly, means removably securing said cutter assembly to said guide assembly, said cutter assembly including means for trimming said paper as it passes said trimming location.

2. A copy trimmer machine in accordance with claim 1, characterized by said means for supporting a roll of paper to be trimmed, including a trough supported transversely of said base frame.

3. A copy trimmer machine in accordance with claim 1, characterized by said guide assembly including a pair of side members, a rod supported by and between said side members, a plurality of guides slidably mounted on said rod, for adjusting the spacing between proximate guides to the width of paper to be guided therebetween, and means for securing said slidably mounted guides in adjusted positions.

4. A copy trimmer machine in accordance with claim 1, characterized by said cutter assembly including a pair of side members, a rod supported by and between said side members, a plurality of cutters slidably mounted on said rod for adjusting the spacing between them to the width of a column to be trimmed.

5. A copy trimmer machine in accordance with claim 3, characterized by said cutter assembly including a pair of side members, a rod supported by and between said side members, a plurality of cutters slidably mounted on said rod for adjusting the spacing between them to the width of a column to be trimmed.

6. A copy trimmer machine in accordance with claim 5, characterized by a pair of rollers supported to the front of said cutters to feed paper from such roll, and means for driving said rollers.

7. A copy trimmer machine in accordance with claim 6, characterized by said means for removably securing said cutter assembly with respect to said guide assembly including means for hingedly securing said cutter assembly at one end to said guide assembly, and means at the opposite end of said cutter assembly for latching said cutter assembly at said opposite end to the proximate end of said guide assembly.

8. A copy trimmer machine in accordance with claim 7, characterized by means for stopping movement of said cutter assembly toward and sufficiently prior to latching engagement with said guide assembly to permit slidable adjustment of said cutters to the material to be trimmed, prior to latching of said cutter assembly to said guide assembly.

* * * * *